US007988461B1

(12) United States Patent
Morgan

(10) Patent No.: US 7,988,461 B1
(45) Date of Patent: Aug. 2, 2011

(54) ELECTRICAL CONNECTOR ASSEMBLY

(75) Inventor: Chad William Morgan, Woolwich Township, NJ (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/729,937

(22) Filed: Mar. 23, 2010

(51) Int. Cl.
*H01R 12/00* (2006.01)

(52) U.S. Cl. ..... 439/78; 439/79

(58) Field of Classification Search ..... 439/78, 439/79, 65

See application file for complete search history.

(56) References Cited

U.S. PATENT DOCUMENTS

| | | | | |
|---|---|---|---|---|
| 4,550,962 | A * | 11/1985 | Czeschka | 439/78 |
| 5,543,586 | A | 8/1996 | Crane, Jr. et al. | |
| 2007/0169961 | A1 | 7/2007 | Kwong et al. | |
| 2008/0207015 | A1 | 8/2008 | Sueyoshi | |

* cited by examiner

*Primary Examiner* — Khiem Nguyen

(57) ABSTRACT

An electrical connector assembly includes a circuit board having vias each extending at least partially through the circuit board along parallel via axes and an electrical connector configured to be mounted on the circuit board. The electrical connector includes a plurality of variable depth signal terminals configured to extend different depths into respective vias of the circuit board. The signal terminals each have a terminal axis, and the signal terminals are arranged in pairs carrying differential pair signals. The signal terminals of each pair extend to the same depth in the respective vias of the circuit board. The terminal axes of the signal terminals of each pair are offset with respect to the corresponding via axes along a majority of the signal terminals within the vias.

20 Claims, 4 Drawing Sheets

ELECTRICAL CONNECTOR ASSEMBLY

BACKGROUND OF THE INVENTION

The subject matter described and/or illustrated herein relates generally to electrical connector systems and, more particularly, to electrical connectors that are mounted on circuit boards.

To meet digital multi-media demands, higher data throughput is often desired for current digital communications equipment. Electrical connectors that interconnect circuit boards must therefore handle ever increasing signal speeds at ever increasing signal densities. One application environment that uses such electrical connectors is in high speed, differential electrical connectors, such as those common in the telecommunications or computing environments. In a traditional approach, two circuit boards are interconnected with one another in a backplane and a daughter board configuration. However, at the footprints of the circuit boards where the electrical connectors connect thereto it may be difficult to improve density while maintaining electrical performance and/or reasonable manufacturing cost. For example, in known circuit boards, vias within the circuit boards are plated, creating plated through holes (PTHs) that are electrically connected to corresponding traces in the circuit board. Contacts extending from the electrical connectors are connected to the PTHs, and thus the traces, using eye-of-the-needle contacts. However, the PTHs create electrical problems, such as low impedance and high cross-talk through the circuit board. One method of improving such footprints is to counterbore a portion(s) of the PTHs to remove the plating to an area just in the vicinity of the corresponding trace in the circuit board. However, the same problems still remain in the short length of the non-bored PTHs that remain for interfacing the contacts with the traces. Such region, though short, still has low impedance, which becomes increasingly problematic at higher transmission speeds.

To achieve higher system densities and speed, further improvement of circuit board footprints and connections to the circuit boards must be made over known approaches. There is a need for an electrical connector that enables improvement of the density and/or electrical performance of circuit board footprints to achieve higher system densities and/or higher system speeds.

BRIEF DESCRIPTION OF THE INVENTION

In one embodiment, an electrical connector assembly is provided that includes a circuit board having vias each extending through the circuit board along parallel via axes from an upper surface of the circuit board to mounting pads of the circuit board. The mounting pads are electrically connected to corresponding traces routed through the circuit board. An electrical connector is mounted on the circuit board. The electrical connector includes a plurality of variable depth signal terminals configured to extend different depths into respective vias of the circuit board. The signal terminals are arranged in pairs carrying differential pair signals, with each pair extending to the same depth in the respective vias of the circuit board. The signal terminals have spring contacts at mounting ends of the signal terminals for surface mounting to the corresponding mounting pads.

In another embodiment, an electrical connector assembly is provided including a circuit board having vias each extending at least partially through the circuit board along parallel via axes. Each via has a mounting pad. An electrical connector is mounted on the circuit board. The electrical connector includes a housing having a mounting face configured to be mounted along the circuit board and a plurality of signal terminals held by the housing. The signal terminals each include mounting contacts extending outward from the mounting face of the housing. The mounting contacts are received in respective vias of the circuit board, and each mounting contact has a spring contact at a mounting end of the mounting contact for surface mounting to the mounting pad within the corresponding via.

In a further embodiment, an electrical connector is provided for mounting on a circuit board having vias with mounting pads exposed within the vias. The electrical connector includes a housing having a mounting face configured to be mounted along the circuit board and a plurality of variable depth signal terminals held by the housing. The signal terminals are configured to extend different depths into respective vias of the circuit board and are arranged in pairs carrying differential pair signals. The signal terminals of each pair extend to the same depth in the respective vias of the circuit board. The signal terminals each include mounting contacts extending outward from the mounting face of the housing, with each mounting contact having a spring contact at a mounting end of the mounting contact for surface mounting to the corresponding mounting pads.

DETAILED DESCRIPTION OF THE INVENTION

Figure 1:
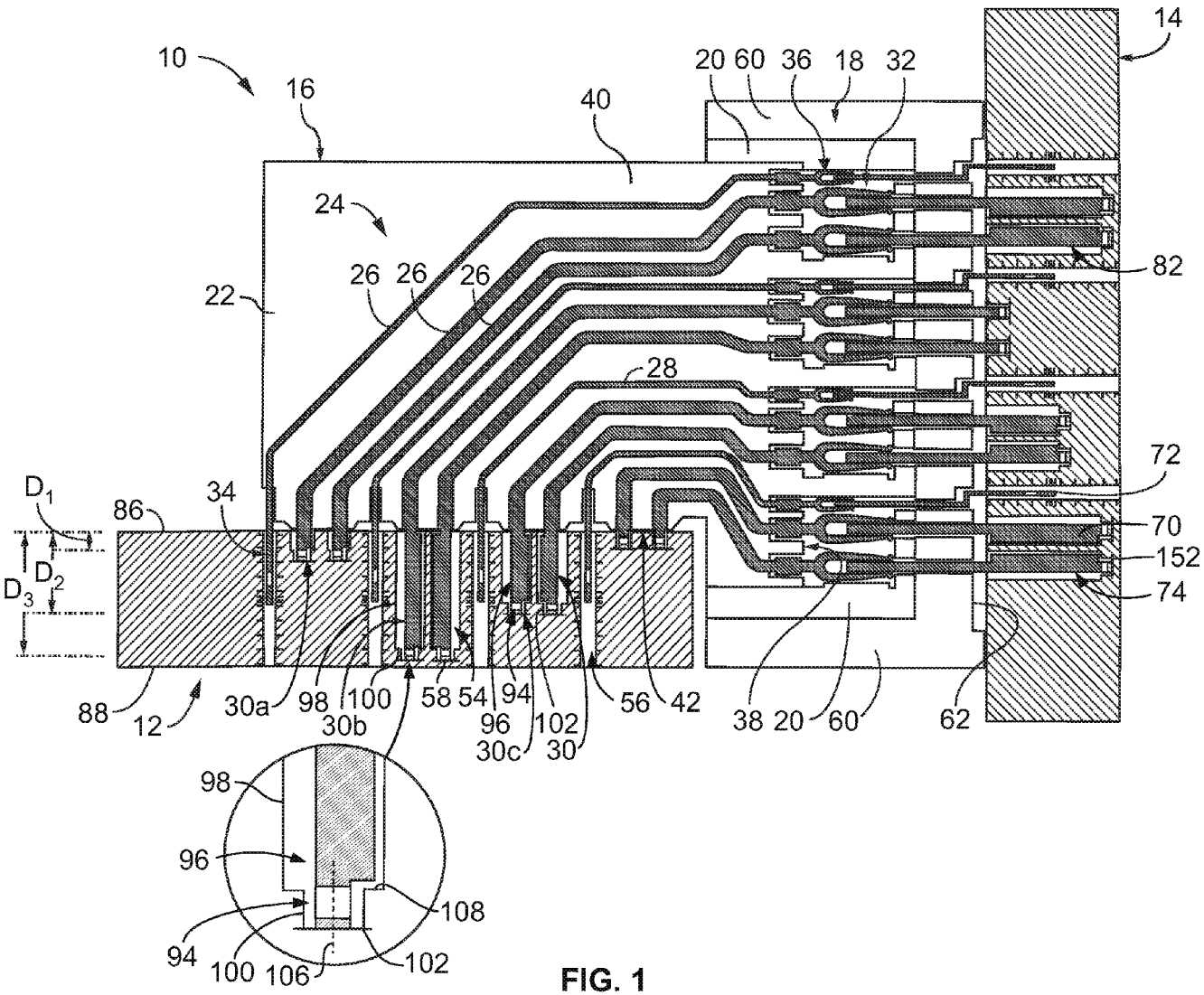
FIG. 1 is a cross-sectional view of an exemplary embodiment of an electrical connector assembly illustrating electrical connectors mounted to circuit boards.

FIG. 1 is a cross-sectional view of an exemplary embodiment of an electrical connector assembly 10. The connector assembly 10 includes a pair of circuit boards 12 and 14, a receptacle connector 16, and a header connector 18. The receptacle connector 16 is mounted on the circuit board 12, and the header connector 18 is mounted on the circuit board 14. The receptacle connector 16 and the header connector 18 are connected together to electrically connect the circuit boards 12 and 14. In the exemplary embodiment of FIG. 1, the receptacle connector 16 and the header connector 18 are oriented such that the connectors 16 and 18 form an approximate right-angle connection between the circuit boards 12 and 14. Alternatively, the receptacle connector 16 and the header connector 18 may be oriented such that the circuit boards 12 and 14 are oriented at any other angle relative to each other, such as, but not limited to, approximately parallel.

The receptacle connector 16 includes a dielectric housing 20 that, in the illustrated embodiment, holds a plurality of parallel contact modules 22 (one of which is illustrated in FIG. 1). The contact module 22 includes a contact lead frame 24 that includes a plurality of signal terminals 26 and a plurality of ground terminals 28. Each signal terminal 26 includes a mounting contact 30 at one end portion of the signal terminal 26 and a mating contact 32 at an opposite end portion of the signal terminal 26. In the illustrated embodiment, the mounting contacts 30 represent spring contacts for surface mounting to corresponding mounting pads 102 of the circuit board 12. The mounting contacts 30 may be referred to hereinafter as spring contacts 30.

Similarly, each ground terminal 28 includes a mounting contact 34 at one end portion of the ground terminal 28 and a mating contact 36 at an opposite end portion of the ground terminal 28. The mounting contacts 34 may be similar to the mounting contacts 30 (e.g. spring contacts), or the mounting contacts 34 may be a different type of contact, such as a pin or an eye-of-the-needle contact as in the illustrated embodiment. The mating contacts 32 and 36 extend outward from, and along, a mating face 38 of the contact module 22. The signal terminals 26 are optionally arranged in differential pairs.

Each contact module 22 includes a dielectric contact module housing 40 that holds the corresponding lead frame 24. Each contact module housing 40 includes the mating face 38 and a mounting face 42. In the illustrated embodiment, the mating face 38 is approximately perpendicular to the mounting face 42. However, the mating face 38 and mounting face 42 may be oriented at any other angle relative to each other, such as, but not limited to, approximately parallel. The mating face 38 of each contact module is received in the housing 20 and is configured to mate with corresponding mating contacts of the header connector 18.

The mounting face 42 of each of the contact modules 22 is configured for mounting on a circuit board, such as, but not limited to, the circuit board 12. The mounting contacts 30 and 34 extend outward from, and along, the mounting face 42 of the contact modules 22 for mechanical and electrical connection to the circuit board 12. Specifically, each of the mounting contacts 30 and 34 is configured to be received within a corresponding via 54 and 56, respectively, within the circuit board 12.

In an exemplary embodiment, the signal terminals 26 constitute variable depth compression connection terminals, where some of the mounting contacts 30 extend different lengths from the mounting face 42 than others of the mounting contacts 30 (whether the others are on the same contact module 22 or a different contact module 22) to different mating depths. Additionally, mounting ends 58 are configured for mating by a compression connection, wherein the mounting ends 58 abut against, and may be partially flexed and/or spring biased against the mounting pads 102 to ensure electrical contact between the mounting contacts 30 and the mounting pads 102.

In the illustrated embodiment, a differential pair 30*a* of the mounting contacts 30 extends to a mating depth $D_1$ from the mounting face 42, a differential pair 30*b* of the mounting contacts 30 extends to a mating depth $D_2$ from the mounting face 42, and a differential pair 30*c* of the mounting contacts 30 extends to a mating depth $D_3$ from the mounting face 42. The depths $D_1$-$D_3$ are each different. Any of the mounting contacts 30 of the receptacle connector 16 may have a different length, and thus a different mating depth, from the corresponding mounting face 42 than any other mounting contact 30 of the receptacle connector 16. The pattern of the lengths of the mounting contacts 30 shown herein is meant as exemplary only.

The header connector 18 includes a dielectric housing 60 that receives the receptacle connector 16 and a mounting face 62 for mounting the header connector 18 to a circuit board, such as, but not limited to, the circuit board 14. The housing 60 holds a plurality of signal terminals 70 and a plurality of ground terminals 72. The signal terminals 70 are optionally arranged in differential pairs, as the signal terminals 70 are shown in the illustrated embodiment.

Each signal terminal 70 includes a mounting contact 74 at one end portion of the signal terminal 70. Each of the mounting contacts 74 is configured to be received within a corresponding via 82 within the circuit board 14. Similar to the mounting contacts 30 of the receptacle connector 16, some of the mounting contacts 74 of the signal terminals 70 extend different lengths from the mounting face 62 of the header connector 18 than others of the mounting contacts 74. The mounting contacts 74 may be similar to the mounting contacts 30 (e.g. spring contacts), or alternatively, the mounting contacts 74 may be of a different type, such as pins or eye-of-the-needle contacts.

The circuit board 12 includes a substrate having a pair of opposite upper and lower surfaces 86 and 88. The mounting face 42 of each of the contact modules 22 is configured to be mounted along the upper surface 86 such that the receptacle connector 16 is mounted on the upper surface 86 of the circuit board 12. The circuit board 12 includes the plurality of vias 54 and 56 that receive the mounting contacts 30 and 34, respectively, of the respective signal and ground terminals 26 and 28. The circuit board 14 may be formed in a similar manner as the circuit board 12.

The vias 54 each include a smaller diameter portion 94 and one or more larger diameter portions 96. The larger diameter portion 96 includes a cylindrical surface 98 extending between the upper surface 86 and the smaller diameter portion 94 along a via axis 106. The larger diameter portion 96 may pass through any number of layers, any number of which may include traces 104 (shown in FIG. 2) routed therethrough. The via 54 is spaced apart from the traces 104 by a certain amount, which may be affected by the diameter of the larger diameter portion 96. The smaller diameter portions 94 each include a cylindrical surface 100 extending between the larger diameter portion 96 and the mounting pad 102. The surfaces 98, 100 may be other non-cylindrical shapes in alternative embodiments. The mounting pad 102 is exposed at a bottom of the smaller diameter portion 94. Optionally, the mounting pad 102 may cover the entire bottom of the smaller diameter portion 94. The mounting pad 102 defines an electrical contact portion for electrical connection with a corresponding one of the mounting contacts 30 of the signal terminals 26. The mounting pad 102 is electrically connected to a signal trace (not shown) of the circuit board 12. In another alternative embodiment, rather than having different diameter portions, the vias 54 may have a constant diameter from the upper surface 86 to the mounting pad 102.

In an exemplary embodiment, the larger diameter portion 96 is created by boring through the layers of the circuit board 12 to the vicinity of the mounting pad 102 (e.g., immediately above the mounting pad 102). The boring stops short of the mounting pad 102 so that the mounting pad 102 is not damaged during the boring process. The smaller diameter portion 94 is created by laser drilling through the bottom of the larger diameter portion 96 to the mounting pad 102. The laser drilling exposes the mounting pad so that the via is open from the upper surface 86 down to the mounting pad 102. Alternative methods and processes may be used to expose the mounting pad 102. For example, the layers of the circuit board 12 above the layer having the mounting pad 102 may be formed with openings, wherein the openings define the via 54 when the circuit board 12 is assembled. Alternatively, the via 54 may be entirely laser drilled or entirely bored to expose the mounting pad 102. Other processes may be used in other embodiments.

The mounting pads 102 of some of the vias 54 are located at respective different depths within the corresponding via 54 relative to the surface 86 of the circuit board 12. The mounting pads 102 themselves are directly engaged by the signal terminals 26, as opposed to having a plated via that is electrically connected to the mounting pad 102, where the signal terminals 26 engage the plated vias. The vias 54 do not include any conductive surfaces that extend longitudinally along the via axes 106 for any amount of length. As such, the vias 54 do not include any areas of low impedance and/or high cross-talk.

When the receptacle connector 16 is mounted on the circuit board 12, the mounting contacts 30 are each received within the corresponding via 54, such that the mounting contacts 30 are electrically connected to the respective mounting pad 102. Some of the mounting contacts 30 of the signal terminals 26 extend different depths, relative to the circuit board surface 86, into the corresponding via 54 than others of the mounting contacts 30 (whether the others are on the same contact module 22 or a different contact module 22). Although the mounting contacts 30 are shown herein as spring contacts, the mounting contacts 30 may each be any suitable type of electrical contact that enables the mounting contacts 30 to function as described herein.

The vias 54 extend through the layers of the circuit board 12 at least partially between the upper and lower surfaces 86, 88. In an exemplary embodiment, the vias 54 extend from the upper surface 86 to the depth of the mounting pads 102. The thickness of the circuit board 12 is a function of the number of layers, and the number of layers may depend, at least in part, on the number of components being connected to the circuit board 12. For example, a backplane circuit board may be substantially thicker than a daughtercard circuit board because many more electrical components are connected to the backplane circuit board as compared to the daughtercard circuit board, thus more layers are required to route the traces through the board.

Figure 2:
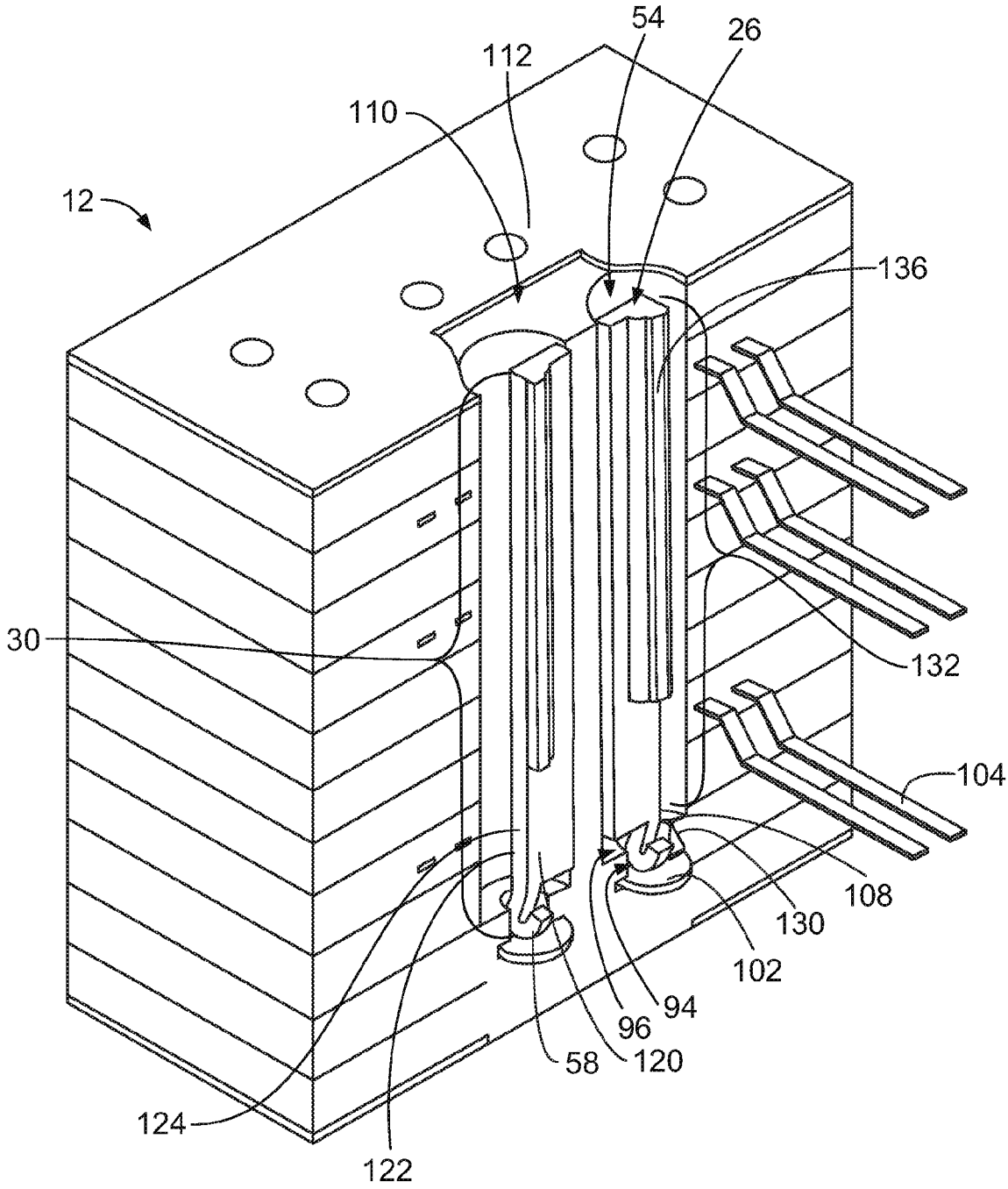
FIG. 2 is a partial cut-away view of the circuit board shown in FIG. 1 illustrating signal terminals mounted to the circuit board.
Figure 3:
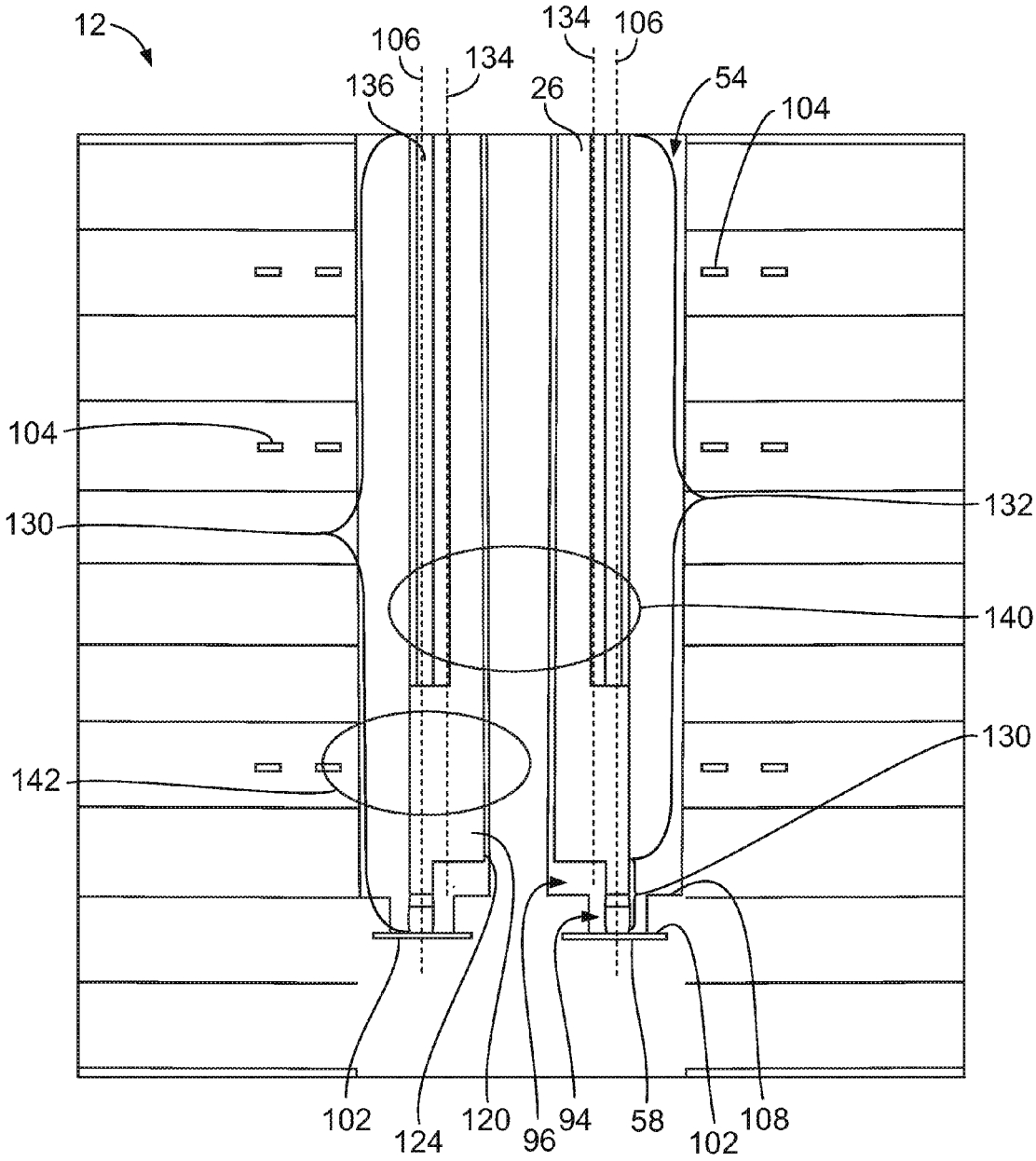
FIG. 3 is a side view of the circuit board and signal terminals shown in FIG. 2.
Figure 4:
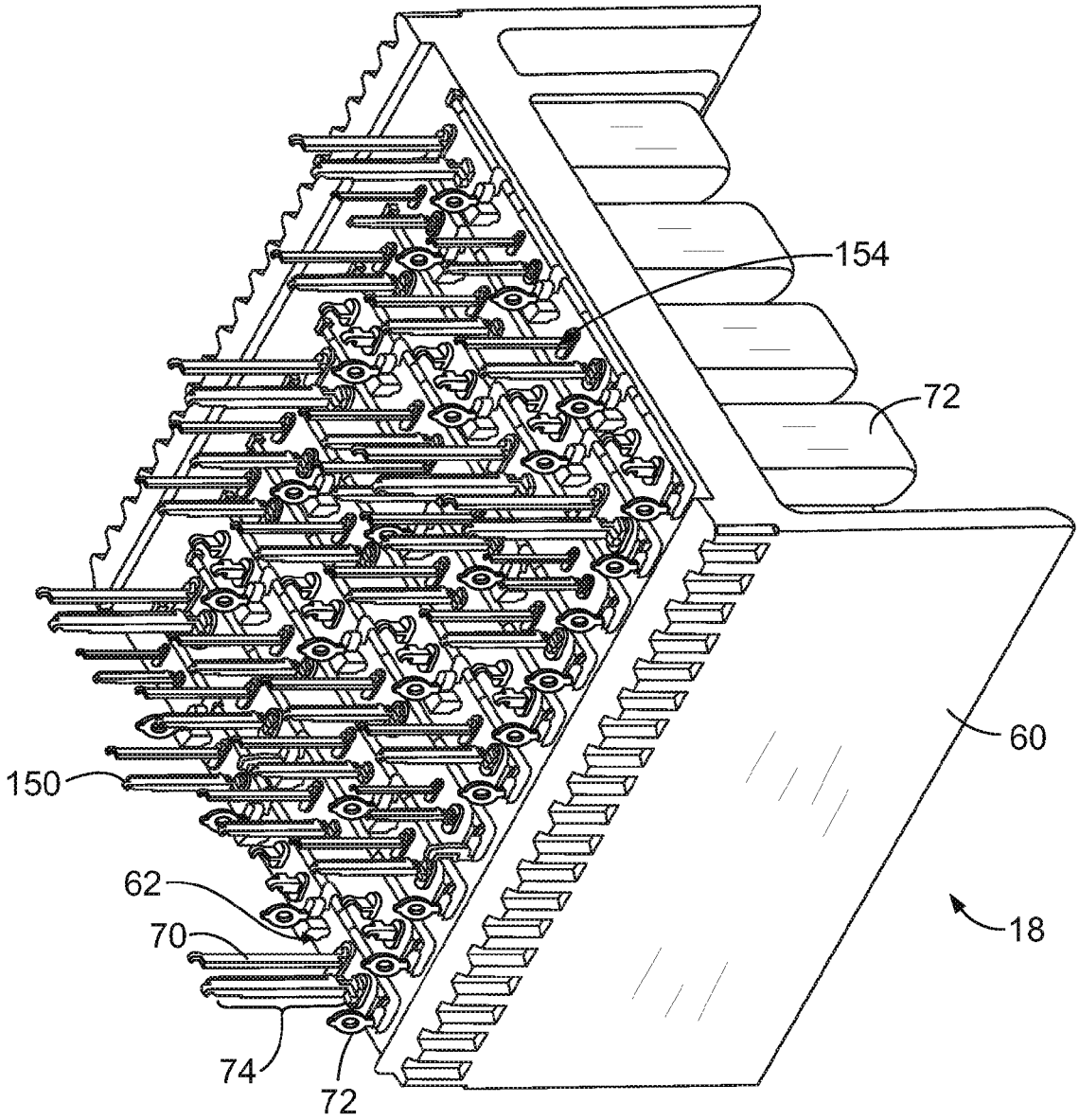
FIG. 4 is a bottom perspective view of one of the electrical connectors shown in FIG. 1.

A shoulder 108 is created at the interface between the upper larger diameter portion 96 and the smaller diameter portion 94. Optionally, the shoulder 108 may be tapered downward toward the via axis 106. In an exemplary embodiment, the diameter of the smaller diameter portion 94 is approximately half the diameter of the larger diameter portion 96. Having a large diameter for the larger diameter portions 96 introduces air in the vias 54 along the via axes 106 around the signal terminals 26. The air affects interpair and intrapair coupling as described in further detail below, such as by lowering cross-talk with neighboring traces 104 and/or raising impedance of the signal terminals 26. The diameter of the larger diameter portion 96 may be restricted by other components of the circuit board 12, such as the proximity of neighboring traces 104 to the vias 54 and/or the spacing between the vias 54 themselves. The diameter of the larger diameter portion 96 may be restricted by a size of one or more opening(s) 110, also known as an antipad, in one or more ground layer(s) 112. The opening 110 and the ground layer 112 are also illustrated in FIG. 4. The ground layer 112 is designed to be a certain distance from the mounting contacts 30 (shown in FIG. 1) to control impedance FIG. 2 is a partial cut-away view of the circuit board 12 illustrating the signal terminals 26 connected to the circuit board 12. FIG. 3 is a side view of the circuit board 12 and signal terminals 26. The mounting contacts 30 of the signal terminals 26 are the only portions of the signal terminals 26 illustrated in FIGS. 2 and 3.

The mounting contacts 30 form part of the lead frame 24 (shown in FIG. 1), and are formed integral with the signal terminals 26 thereof. In an exemplary embodiment, the lead frame 24 is stamped and formed to define the signal terminals 26. When stamped, the signal terminals 26 are separated from one another and are generally co-planar with one another. The planar sides of the stock of material used to form the lead frame 24 define a first side 120 and a second side 122 of the signal terminals 26, which are parallel to one another. Cut sides 124 extend between the first and second sides 120, 122, which are defined during the stamping process by shearing off the unused stock material. The individual signal terminals may then be formed by bending, folding or otherwise manipulating the signal terminals 26 to give the signal terminals 26 a final shape. Once formed, the first and second sides 120, 122 may not necessarily be parallel to one another.

The mounting contacts 30 are the portions of the signal terminals 26 extending from the mounting face 42 of the contact modules 22 (both shown in FIG. 1). The mounting contacts 30 are received within the vias 54. The mounting contacts 30 include a mounting portion 130 and a transition portion 132. The mounting portion 130 engages the mounting pad 102 within the corresponding via 54. In the illustrated embodiment, the mounting portion 130 is represented by a spring beam having a curved shape that may be compressed or deflected during mounting to the mounting pad 102. The deflection causes the spring beam to impart a spring force against the mounting pad 102. As illustrated in FIG. 3, the mounting portion 130 is hook shaped, however other shapes are possible which allow the mounting portion 130 to compress during mounting so that the mounting portion 130 is biased against the mounting pad 102.

The transition portion 132 extends between the mounting face 42 and the mounting portion 130. The transition portion 132 is generally offset with respect to the mounting portion 130. In the illustrated embodiment, the transition portions 132 of the pair of mounting contacts 30 are offset toward one another relative to the mounting portions 130. The amount of offset is established to control the impedance of the mounting contacts 30 and/or cross-talk between the mounting contacts 30 and neighboring traces 104. For example, the transition portions 132 are offset toward one another, such as to decrease impedance of the mounting contacts 30. Optionally, the transition portions 132 may be offset away from the neighboring traces 104, such as to reduce cross-talk between the mounting contacts 30 and the neighboring traces 104.

The larger diameter portions 96 of the vias 54 provide space for the transition portions 132 to be offset from the via axes 106 (shown in FIG. 3). For example, while the mounting portions 130 are aligned with the via axes 106, parts of the transition portions 132 are aligned vertically above the shoulder 108, which would not be possible without the oversized boring process. In an exemplary embodiment, the larger diameter portions 96 are filled with air, which has a dielectric constant of approximately 1.0, as opposed to the material of the circuit board 12, which may be FR-4 having a dielectric constant of approximately 4.3. The air surrounding the mounting contacts 30 affects the electrical characteristics of the mounting contacts 30, such as by affecting the interactions between the adjacent mounting contacts 30 and/or by affecting the interactions between the mounting contacts 30 and the neighboring traces 104.

In an exemplary embodiment, the mounting contacts 30 define signal propagation paths through the circuit board 12, and the mounting contacts 30 are oriented such that the mounting contacts 30 are offset from the via axes 106 along a majority of the signal propagation paths. The mounting contacts 30 each have a terminal axis 134 (shown in FIG. 3) defined at a cross-sectional center of the mounting contacts 30 along the length of the mounting contacts 30. The cross-sectional center is the center of gravity of the signal terminal 26 along any given cross-section taken along the length of the signal terminal 26. The length of the signal terminal 26 is defined as the longitudinal length of the signal terminal 26 (e.g. between the mounting contact 30 and the mating contact 32 (shown in FIG. 1)). The terminal axes 134 of the mounting contacts 30 of each pair are offset with respect to the corresponding via axes 106 along a majority of the mounting contacts 30 within the vias 54. Optionally, the terminal axes 134 along the mounting portions 130 are generally coincident with the via axes 106, while the terminal axes 134 along the transition portions 132 are non-coincident with the via axes 106. The terminal axes 134 of the transition portions 132 are offset with respect to the terminal axes 134 of the mounting portions 130. The amount of offset is selected to control the electrical characteristics of the mounting contacts 30.

Intrapair and interpair interactions can be understood with reference to FIG. 3, which illustrates an intrapair interaction zone 140 and an interpair interaction zone 142. The intrapair interaction zone 140 is generally provided between the mounting contacts 30 within a differential pair. The interpair interaction zone 142 is generally provided between the mounting contacts 30 and the neighboring traces 104. With the boring of a large amount of material of the circuit board 12 to create relatively large diameter vias 54, as compared to the size of the mounting contacts 30, a large air gap is provided around each mounting contact 30. The large air gap affects the intrapair coupling in the intrapair interaction zone 140, such as by raising the impedance. However, depending on the diameter of the bore, the air gap may raise the impedance above a desired level (e.g. 100 Ohms), which may cause signal degradation. By having the transition portions 132 shifted toward one another, the impedance may be lowered to the desired level (e.g. 100 Ohms, however other levels are possible in alternative embodiments depending on the particular application). The shape of the mounting contacts 30, particularly in the transition portions 132, may be selected to obtain the desired impedance. As such, intrapair coupling in the intrapair interaction zone 140 may be controlled by selecting the shape and spacing of the mounting contacts 30 within each differential pair.

The large air gap also affects the interpair coupling in the interpair interaction zone 142, such as by lowering trace-to-terminal crosstalk. The introduction of air between the traces 104 and the mounting contacts 30 helps reduce crosstalk therebetween because air has a lower dielectric constant than the circuit board 12 material. Additionally, by having the transition portions 132 shifted away from the traces 104, the trace-to-terminal crosstalk may be further reduced as compared to a situation in which the transition portions 132 were not shifted. As such, interpair coupling in the interpair interaction zone 142 may be controlled by orienting each mounting contacts 30 in a particular location relative to the neighboring traces 104. Furthermore, by having the cut sides 124 facing the neighboring traces 104, as opposed to the first and second sides 120, 122, a narrower portion of the mounting contacts 30 faces the neighboring traces 104, which may also reduce trace-to-terminal cross-talk.

In the illustrated embodiment, the mounting contacts 30 are stamped and formed in a predetermined manner to provide predetermined electrical characteristics. For example, the mounting contacts 30 are formed and positioned with respect to one another and the neighboring traces 104 to control impedance between the mounting contacts 30 of the differential pair and to control cross-talk with neighboring traces 104. The mounting contacts 30 are stamped with the centerlines of the transition portions 132 being non-coincident with the centerlines of the mounting portions 130. The centerlines are staggered or shifted with respect to one another such that the transition portions 132 of the mounting contacts 30 within each pair are shifted toward one another with respect to the mounting portions 130 of the mounting contacts 30 within each pair.

In an exemplary embodiment, the transition portions 132 also include a folded over portion 136 along at least a portion of the length of the transition portion 132. The folded over portion 136 is defined during the forming process. The folded over portion 136 defines a strengthening rib, and may be referred to hereinafter as a strengthening rib 136. The strengthening rib 136 provides rigidity to the transition portion 132 and helps prevent buckling of the mounting contact 130 during mounting of the receptacle connector 16 to the circuit board 12. Optionally, the strengthening rib 136 may be formed by other methods or processes other than folding over the mounting portion 130, including being a separate piece that is attached to the mounting portion 130. Optionally, a dielectric support collar (not shown) at least partially surrounds the transition portion 132. The support collar supports the transition portion 132, such as to prevent buckling.

FIG. 4 is a bottom perspective view of the header connector 18. The housing 60 holds the signal terminals 70 and the ground terminals 72. The signal terminals 70 are arranged in differential pairs and the ground terminals 72 provide shielding between the pairs within the housing 60. The mounting contacts 74 extend from the mounting face 62 to different depths from the mounting face 62. The mounting contacts 74 represent variable depth compression connectors. For example, the mounting contacts 74 include mounting ends 150 having spring beams. The mounting ends 150 are curved into a hook shape to define spring contacts for mounting to mounting pads 152 (shown in FIG. 1) within the circuit board 14 (shown in FIG. 1). FIG. 4 also illustrates that the mounting contacts 74 are offset toward one another at jogged sections 154 adjacent the mounting face 62. The jogged sections 154 could be provided at any location along the length of the mounting contacts 74.

The ground terminals 72 have eye-of-the-needle contacts at mounting ends thereof, however other types of contacts may be provided in alternative embodiments. In the illustrated embodiment, each of the ground terminals 72 extends from the mounting face 62 the same length for mounting to the circuit board 14. However, the ground terminals 72 may be variable in length in alternative embodiments.

The embodiments described and/or illustrated herein provide an electrical connector that may enable improvement of the density and/or electrical performance of circuit board footprints to achieve higher system densities and/or higher system speeds. For example, the embodiments described and/or illustrated herein, when left at the same density as at least some known systems, may decrease via to via coupling and may increase circuit board footprint impedance. Alternatively, the embodiments described and/or illustrated herein may be able to achieve higher footprint densities than at least some known systems while maintaining the same via to via coupling and impedance levels of such known systems. The embodiments described and/or illustrated herein may provide improved electrical characteristics between signal terminals of the electrical connector.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a circuit board comprising vias each extending through the circuit board along parallel via axes from an upper surface of the circuit board to mounting pads of the circuit board, the mounting pads being electrically connected to corresponding traces routed through the circuit board; and an electrical connector mounted on the circuit board, the electrical connector comprising a plurality of variable depth signal terminals configured to extend different depths into respective vias of the circuit board, the signal terminals being arranged in pairs carrying differential pair signals, each signal terminal within the corresponding pair extending to the same depth in the respective vias of the circuit board, the signal terminals having spring contacts at mounting ends of the signal terminals for surface mounting to the corresponding mounting pads.

2. The assembly of claim 1, wherein the signal terminals represent compression contacts directly engaging mounting surfaces of the corresponding mounting pads.

3. The assembly of claim 1, wherein the circuit board is a multi-layered circuit board having an outer layer and internal layers, the electrical connector be mounted to the outer layer of the circuit board, the mounting pads being provided in, or on, an internal layer of the circuit board, the mounting pads being exposed at a bottom of the corresponding vias at a depth below the upper surface of the circuit board.

4. The assembly of claim 1, wherein each via includes a smaller diameter portion and a larger diameter portion with a shoulder defined between the smaller and larger diameter portions, the larger diameter portion being formed during a boring process through the circuit board to the vicinity of the mounting pad, the smaller diameter portion being laser drilled from a bottom of the larger diameter portion to the mounting pad, the mounting pad being exposed at a bottom of the smaller diameter portion.

5. The assembly of claim 1, wherein each via includes a smaller diameter portion and a larger diameter portion with a shoulder defined between the smaller and larger diameter portions, the smaller diameter portion extending between the larger diameter portion and the mounting pad with the mounting pad being exposed at a bottom of the smaller diameter portion, the signal terminals having transition portions being arranged within the larger diameter portions and being aligned vertically above the shoulders.

6. The assembly of claim 1, wherein the mounting pads are disk shaped and encompass an entire bottom of the vias, the mounting pads being perpendicular to the via axes.

7. The assembly of claim 1, wherein the signal terminals each have a terminal axis, the terminal axes of the signal terminals of each pair being offset with respect to the corresponding via axes along a majority of the signal terminals within the vias.

8. The assembly of claim 1, wherein signal terminals each have a terminal axis, the signal terminals including a mounting portion and a transition portion, the terminal axes along the mounting portions being coincident with the via axes, the terminal axes along the transition portions being non-coincident with the via axes.

9. An electrical connector assembly comprising:

a circuit board comprising vias each extending at least partially through the circuit board along parallel via axes, each via having a mounting pad; and an electrical connector mounted on the circuit board, the electrical connector comprising:

a housing having a mounting face configured to be mounted along the circuit board; and a plurality of signal terminals held by the housing, the signal terminals each comprising mounting contacts extending outward from the mounting face of the housing, the mounting contacts being received in respective vias of the circuit board, each mounting contact having a spring contact at a mounting end of the mounting contact for surface mounting to the mounting pad within the corresponding via.

10. The assembly of claim 9, wherein the signal terminals represent compression contacts directly engaging mounting surfaces of the corresponding mounting pads.

11. The assembly of claim 9, wherein the mounting pads are exposed at a bottom of the corresponding vias at a depth below the upper surface of the circuit board, the mounting pads being generally perpendicular to the via axes.

12. The assembly of claim 9, wherein each via includes a smaller diameter portion and a larger diameter portion with a shoulder defined between the smaller and larger diameter portions, the larger diameter portion being formed during a boring process through the circuit board to the vicinity of the mounting pad, the smaller diameter portion being laser drilled from a bottom of the larger diameter portion to the mounting pad, the mounting pad being exposed at a bottom of the smaller diameter portion.

13. The assembly of claim 9, wherein each via includes a smaller diameter portion and a larger diameter portion with a shoulder defined between the smaller and larger diameter portions, the smaller diameter portion extending between the larger diameter portion and the mounting pad with the mounting pad being exposed at a bottom of the smaller diameter portion, the signal terminals having transition portions being arranged within the larger diameter portions and being aligned vertically above the shoulders.

14. The assembly of claim 9, wherein the signal terminals each have a terminal axis, the terminal axes of the signal terminals of each pair being offset with respect to the corresponding via axes along a majority of the signal terminals within the vias.

15. The assembly of claim 9, wherein the signal terminals each have a terminal axis defined at a cross-sectional center of the signal terminals along the length of the signal terminals, each mounting contact having a transition portion extending between the mounting face of the housing and the mounting portion of the mounting contact, the terminal axis of the transition portion being offset with respect to the terminal axis of the mounting portion.

16. An electrical connector for mounting on a circuit board having vias with mounting pads exposed within the vias, the electrical connector comprising:

a housing having a mounting face configured to be mounted along the circuit board; and a plurality of variable depth signal terminals held by the housing, the signal terminals being configured to extend different depths into respective vias of the circuit board, the signal terminals being arranged in pairs carrying differential pair signals, the signal terminals of each pair extending to the same depth in the respective vias of the circuit board, the signal terminals each comprising mounting contacts extending outward from the mounting face of the housing, each mounting contact having a spring contact at a mounting end of the mounting contact for surface mounting to the corresponding mounting pads.

17. The electrical connector of claim 16, wherein the signal terminals represent compression contacts engaging mounting surfaces of the corresponding mounting pads.

18. The electrical connector of claim 16, wherein the signal terminals each have a terminal axis, the terminal axes of the signal terminals of each pair being offset with respect to the corresponding via axes along a majority of the signal terminals within the vias.

19. The electrical connector of claim 16, wherein the signal terminals each have a terminal axis defined at a cross-sectional center of the signal terminals along the length of the signal terminals, each mounting contact having a transition portion extending between the mounting face of the housing and the mounting portion of the mounting contact, the terminal axis of the transition portion being offset with respect to the terminal axis of the mounting portion.

20. The electrical connector of claim 16, wherein the mounting portions are hook shaped, the mounting portions being spring biased against the mounting pad when engaged thereto.

* * * * *